US006729480B1

(12) United States Patent
Blake

(10) Patent No.: US 6,729,480 B1
(45) Date of Patent: May 4, 2004

(54) DRILL TOOL STRAP ASSEMBLY

(76) Inventor: Donald Blake, 12555 N. 77th Dr., Peoria, AZ (US) 85381

( * ) Notice: Subject to any disclaimer, the term of this patent is extended or adjusted under 35 U.S.C. 154(b) by 0 days.

(21) Appl. No.: 10/041,211

(22) Filed: Jan. 4, 2002

(51) Int. Cl.[7] ..... A47F 7/00
(52) U.S. Cl. ..... 211/70.6; 211/69.1; 206/379
(58) Field of Search ..... 211/70.6, 69.1; 206/379; 248/205.2; 224/223; 383/39; 408/241 R

(56) References Cited

U.S. PATENT DOCUMENTS 4,508,221 A * 4/1985 Olson ..... 206/379
4,797,040 A * 1/1989 Hibbard ..... 408/241 R
4,809,974 A * 3/1989 Buhr ..... 482/139
4,848,980 A * 7/1989 Broussard ..... 408/67
4,893,381 A * 1/1990 Frankel ..... 24/16 R
4,936,571 A * 6/1990 Buhr ..... 482/105
4,966,321 A * 10/1990 Outlaw ..... 224/674
5,711,055 A * 1/1998 Quick ..... 24/16 R
5,752,848 A * 5/1998 Youngmark ..... 439/369
5,810,525 A * 9/1998 Ector, Sr. ..... 408/241 R
5,842,584 A * 12/1998 Baird ..... 211/69.1
5,984,046 A * 11/1999 Urso, Jr. ..... 182/129
6,098,558 A * 8/2000 Baird ..... 112/475.08
6,496,094 B2 * 12/2002 May, III ..... 335/285

* cited by examiner

*Primary Examiner*—Daniel P. Stodola
*Assistant Examiner*—Khoa Tran
(74) *Attorney, Agent, or Firm*—Schmeiser, Olsen & Watts, LLP

(57) ABSTRACT

A strap assembly including at least one strap configured to removably mount on a handle portion of a drill, to removably twist 180° and mount on a rear end portion of the drill, and to removably mount on a rear body portion of the drill.

17 Claims, 8 Drawing Sheets

DRILL TOOL STRAP ASSEMBLY

BACKGROUND OF THE INVENTION

1. Technical Field

This invention relates to the field of power tool accessories, and more specifically, to a drill tool and accessory strap assembly.

2. Background Art

Hand-held power drills, externally powered or cordless, are extensively used by drill operators including electricians, plumbers, carpenters, masons, drywall hangers, HVAC technicians, metal fashioners, painters, roofers, and homeowners. One of the most common problems shared by drill operators is the temporary, secure storage and retrieval of drill tools and accessories. Often, these drill tools are relatively small and easy to misplace. However, these small drill tools are critical to the performance of the power drill and must be stored securely while still allowing ready and immediate access without interfering with the operation of the power drill.

Various devices have been used to hold drill tools required for operating hand-held power drills. However, these conventional drill tool holding devices have certain drawbacks that have long existed and have not been effectively overcome.

For example, drill tools are often stored in the tool's original packaging, but this approach fails if the package is missing, destroyed, or otherwise rendered inoperative. Alternatively, drill tools are simply thrown into a large toolbox, belt pouch, pocket, and the like where they can be lost or damaged. Additionally, when working with a combination of different drill tools when an application requires going back and forth from tool to tool, drill tools are quite often lost or misplaced momentarily in a tool box, pouch, pocket, or the like, thereby necessitating a time consuming search.

Other types of drill tool holding devices are on-drill storage systems. One example of an on-drill storage system consists of a storage bay built into a drill's housing. However, storage bays are limited to screw bits only, and therefore, are not versatile (i.e., the storage bays do not accommodate a variety of different shapes and sizes of drill tools). Another example of an on-drill storage system consists of a recessed magnet in the lower portion of the drill handle. However, only metal tools are able to be held in place, while other non-metal accessories commonly used during drilling applications (e.g. a pencil, a tube of oil, a brush, etc.) are not able to be held in place on the drill.

Still other drill tool holding devices mounted on the drill handle or front drill body rely upon sleeve, band, or belt holding devices to retain the drill tools against the drill. However, these conventional holding devices suffer from the tendency of the device to slip off the handle portion or the body portion of the drill over time and heavy use (i.e., inserting and removing drill tools from the strap, band, or belt holding devices), thereby effectively rendering such devices ineffective for securely storing drill tools for ready and immediate access. Furthermore, tools held on the drill handle make the drill handle difficult and uncomfortable to grip by a drill operator.

Therefore, what is needed is drill tool holding device that is versatile, securely stores and maintains accessible various drill tools and accessories, and does not slip off the drill over time and heavy use.

DISCLOSURE OF THE INVENTION

The invention solves the aforementioned disadvantages of conventional drill tool holding devices through a strap assembly for securely holding virtually any drill tool and accessory on a hand-held power drill. The strap assembly may generally include at least one strap having a first end portion coupled to a second end portion. The at least one strap may be configured to removably mount on a handle portion of the drill, to removably twist 180° and mount on a rear end portion of the drill, and to removably mount on a rear body portion of the drill.

The invention also solves the problems of conventional drill tool holding devices through a method for fabricating the strap assembly and a method for mounting the strap assembly in an operative position on a hand-held power drill. The fabrication method of the invention may generally include steps of: twisting the at least one strap 360° about a longitudinal axis extending from the first end portion of the strap to the second end portion of the strap; and coupling the first end portion to the second end portion. The mounting method of the invention may generally include steps of: removably mounting the at least one strap on the handle portion of the drill; removably twisting 180° and mounting the at least one strap on the rear end portion of the drill; and removably mounting the at least one strap on the rear body portion of the drill.

Accordingly, the strap assembly and associated fabrication and installation methods of the invention provide many advantages. For example, the strap assembly is versatile in that it may hold many shapes and sizes of tools and accessories. The strap assembly may also resist sliding off the drill over time and heavy use (during the removal and insertion of tools and accessories) if the strap assembly is mounted on both the handle portion and the rear body portion of a drill in such a manner that the strap assembly crosses itself at a rear end portion of the drill for example. Additionally, the strap assembly may protect the body of the drill if dropped or laid on it's side, as well as add to the comfort of the drill handle by cushioning the hand from the hard plastic and the vibrations of the drill. Furthermore, the strap assembly may act as a trigger hold in that the portion of the at least one strap around the handle may be configured to be pulled up over the trigger to maintain the trigger in a depressed position. Moreover, the strap assembly may fit virtually any make and model of hand-held power drills, externally powered or cordless.

The foregoing and other features and advantages of the invention will be apparent to those of ordinary skill in the art from the following more particular description of the invention and the accompanying drawings.

BRIEF DESCRIPTION OF THE DRAWINGS

The invention will hereinafter be described in conjunction with the appended drawings, where like designations denote like elements, and.

DETAILED DESCRIPTION OF THE INVENTION

Figure 1:
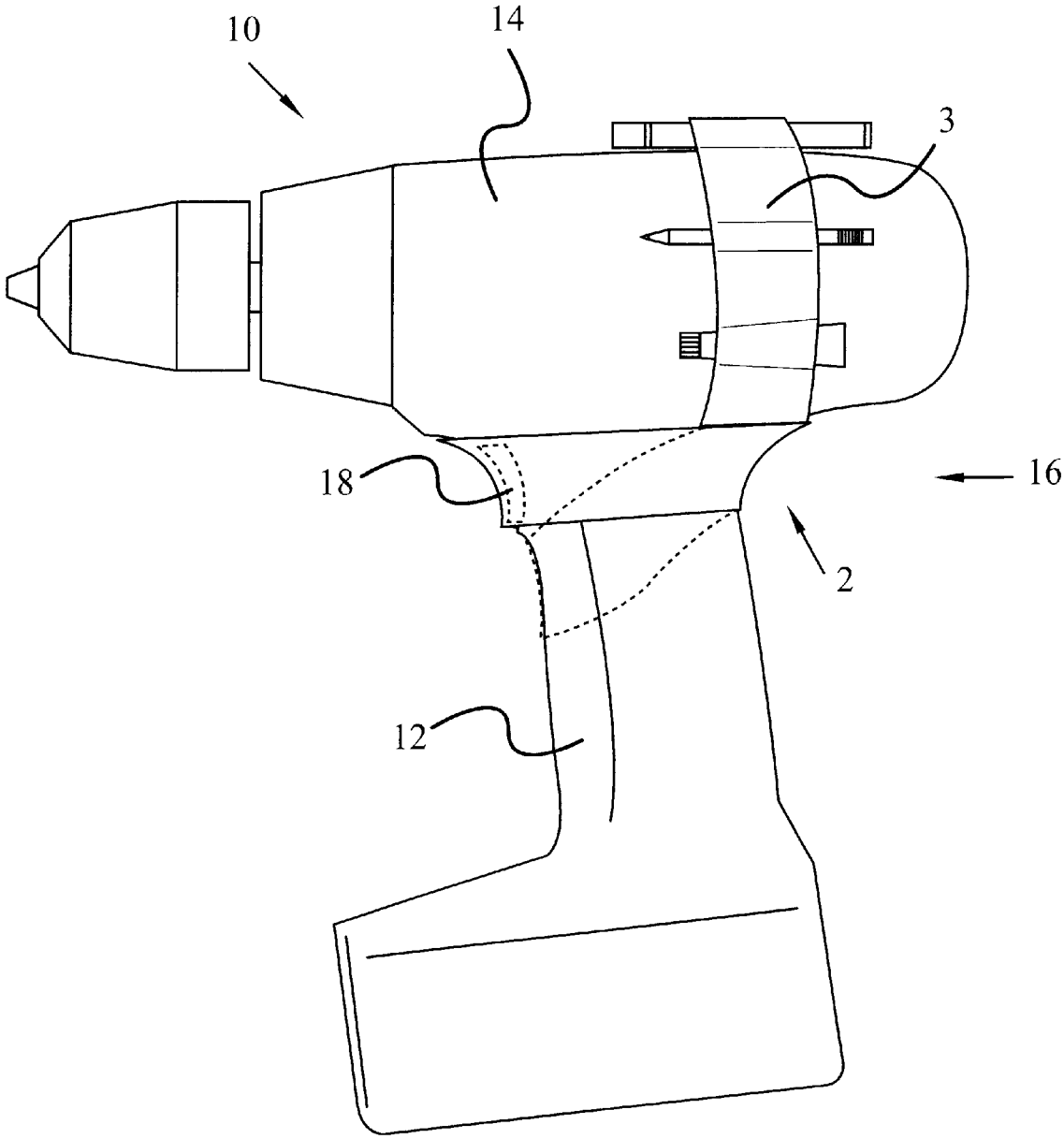
FIG. 1 is a side plan view of a strap assembly embodiment of the invention with the strap assembly in an operative position on a cordless hand-held power drill.

A strap assembly of the invention provides many advantages including holding virtually any type, shape, and size of drill tool and accessory, fitting virtually any make and model of hand-held power drills, and remaining mounted on a drill over time and heavy use. Generally, a strap assembly may comprise at least one strap having a first end portion coupled to a second end portion, wherein the at least one strap is configured to removably mount on a handle portion of the drill, to removably twist 180° and mount on a rear end portion of the drill, and to removably mount on a rear body portion of the drill. Accordingly, although the invention may be readily adapted to a variety of embodiments of a strap assembly, with reference to FIGS. 1, 2, 4–6, and 7–9, strap assemblies 2, 4, and 6 are examples of a strap assembly of the invention. It will be understood by one of ordinary skill in the art that the invention is not limited to the specific structures illustrated in the drawings.

Figure 7:
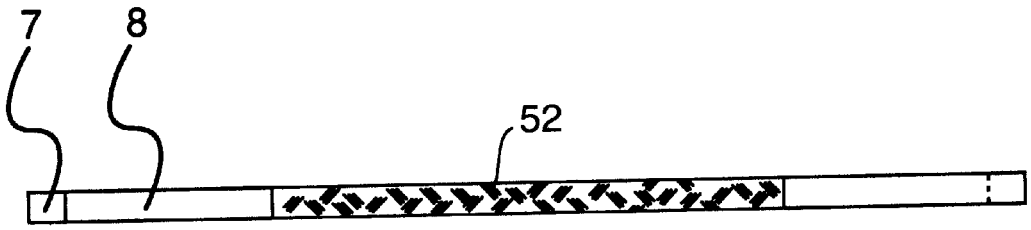
FIGS. 7–9 are top plan views during the fabrication of another strap assembly embodiment of the invention.
Figure 8:
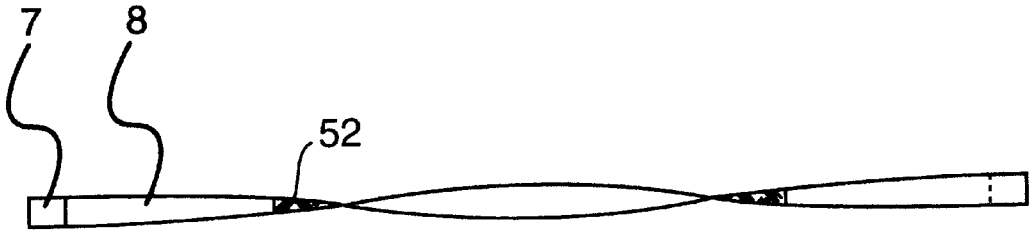
Figure 9:
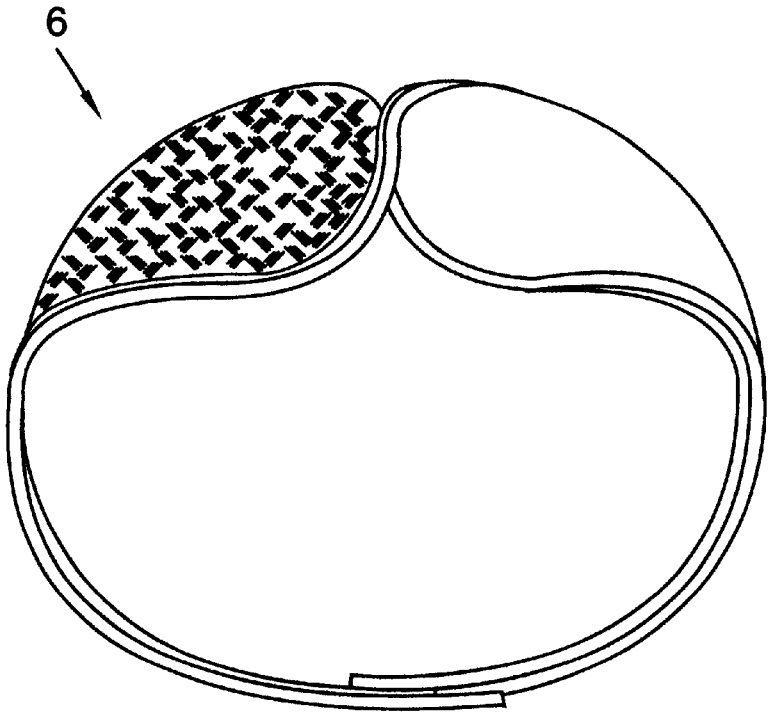

As depicted in FIG. 1, strap assembly 2 includes strap 3 having a first end portion coupled to a second end portion. Strap 3 is configured to removably mount on handle portion 12 of cordless hand-held power drill 10, to removably twist 180° and mount on rear end portion 16 of drill 10, and to removably mount on a rear portion of body portion 14 of drill 10 (e.g. approximately the junction of handle portion 12 and rear portion of body portion 14). Referring to FIGS. 2 and 4–6, strap assembly 4 includes strap 5 that overlaps itself to form at least two strap portions, and may also include sleeves 9 as will hereinafter be described. Turning to FIGS. 7–9, strap assembly 6 includes outer strap 7 overlapping inner strap 8. Outer strap 7 and inner strap 8 each have a first end portion at least coupled to a second end portion. Similar to strap assembly 2, the at least two strap portions of strap assembly 4 and outer strap 7 and inner strap 8 of strap assembly 6 are also configured to removably mount on drill 10. As will be made clear, strap assemblies 2, 4, and 6, variations thereof, and other strap assembly embodiments of the invention may be fabricated and mounted in operative positions on drills in a variety of different manners.

Figure 2:
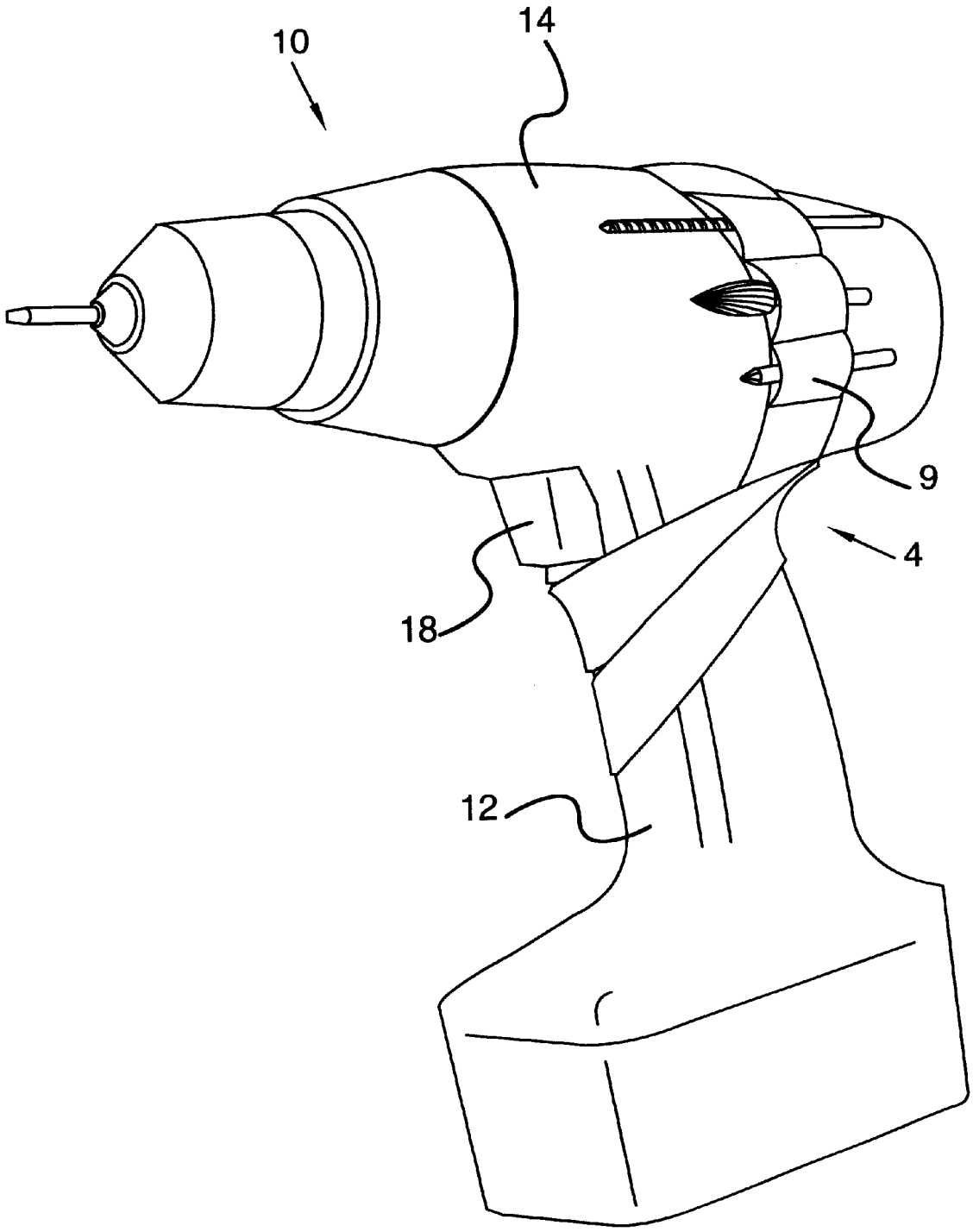
FIG. 2 is an isometric plan view of another strap assembly embodiment of the invention in an operative position on the cordless hand-held power drill.

Describing the fabrication of strap assembly embodiments of the invention, it is within the scope of the invention for any strap assembly embodiment to be fabricated in any manner. Referring to FIG. 2 and for the exemplary purposes of this disclosure, exemplary method 20 for fabricating a strap assembly in accordance with the invention is illustrated. Generally, fabrication method 20 of invention may form a strap assembly embodiment comprising at least one strap having a first end portion and a second end portion by: twisting the at least one strap 360° about a longitudinal axis extending from the first end portion to the second end portion; and coupling the first end portion to the second end portion. As will be made clear, fabricating strap assemblies in this manner allows them to conform to a shape of a drill when mounted thereon in an operative position. However, it will be understood by one of ordinary skill in the art that the invention is not limited to forming a specific strap assembly embodiment in a specific manner, as any strap assembly embodiment described herein may be formed in any manner.

Figure 3:
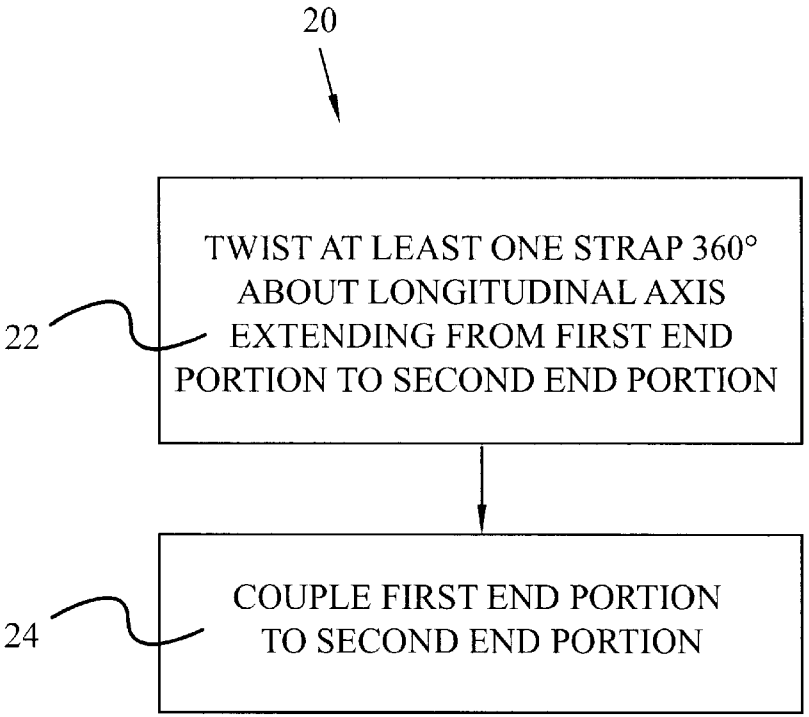
FIG. 3 is a flow diagram illustrating a method for fabricating a strap assembly embodiment of the invention.

With reference to FIG. 1 and for the exemplary purposes of this disclosure, strap assembly 2 is depicted after fabrication method 20 of FIG. 3. First step 22 is to twist strap 3 360° about a longitudinal axis extending from its first end portion to its second end portion. Next step 24 is to couple the first end portion to the second end portion, thereby forming strap assembly 2. As depicted in FIG. 1, when strap assembly 2 is then mounted on drill 10 in an operative position it conforms to the shape of drill 10 as will hereinafter be described. Alternatively, strap assembly 2 may be formed without implementing step 22 so that strap 3 will not conform to a shape of drill 10 when mounted thereon in an operative position.

Whether implementing step 22 or not, a further step may be included of coupling a slip resistant backing 50 to at least a portion of an inner side of strap 3. Slip resistant backing 50 is formed of any material that facilitates hampering or preventing a strap assembly from sliding off a drill over time and heavy use. Any portion of the inner side or the entire inner side of strap 3 that is configured to be adjacent a drill when strap 3 is mounted on the drill may have slip resistant backing 50 coupled thereon (e.g. by direct sewing, by adhesives, by hook and loop fasteners, or by any other secure coupling method), or backing 50 may be integrally formed therewith. However, for the exemplary purposes of this disclosure, slip resistant backing 50 may be coupled to at least a portion of an inner side of strap 3 that is configured to be mounted on a rear body portion of a drill. Another step may also be included of either perforating at least a portion of strap 3 or providing a prefabricated, perforated strap 3. Strap 3 may have any type, size, or shape perforations suitable to allow ventilation slots of drill body 14 to remain in communication with the atmosphere when strap assembly 2 is mounted in an operative position on drill 10 so as to allow airflow there through to cool the motor of drill 10.

Figure 4:
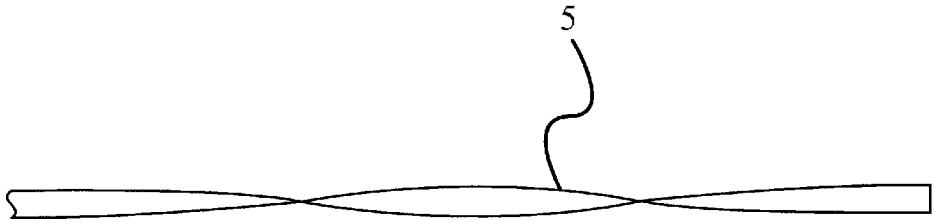
FIGS. 4–6 are top plan views during the fabrication of the strap assembly embodiment of FIG. 2.
Figure 5:
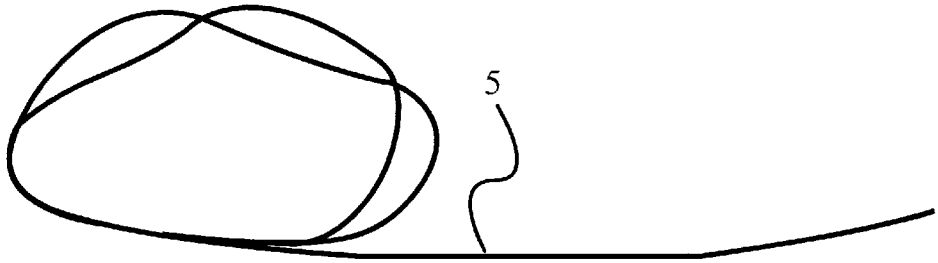
Figure 6:
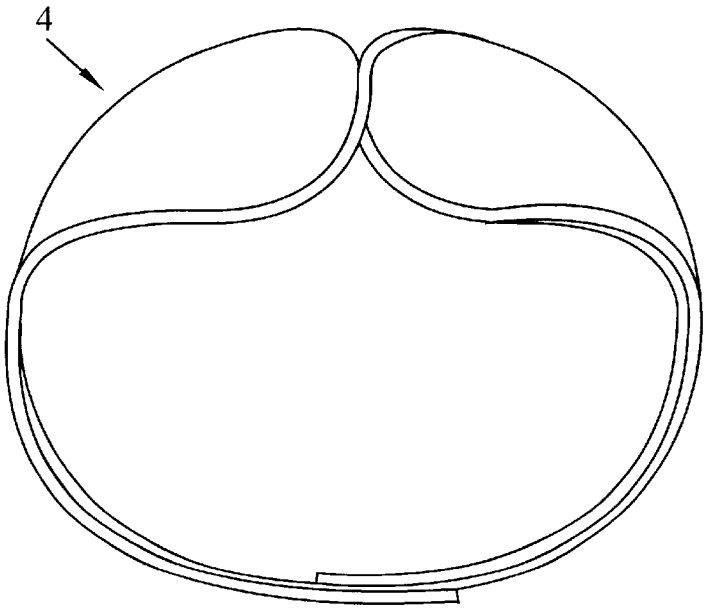

Turning to FIGS. 4–6 and for the exemplary purposes of this disclosure, top plan views are depicted during the fabrication of strap assembly 4 of FIG. 2 according to fabrication method 20 of FIG. 3. First step 22 depicted in FIG. 4 is to twist strap 5 360° about a longitudinal axis extending from its first end portion to its second end portion. A next step depicted in FIGS. 5–6 is included of overlapping strap 5 upon itself to form at least two strap portions. Last step 24 depicted in FIG. 6 is to couple the first end portion to the second end portion, thereby forming strap assembly 4 with at least two strap portions. As depicted in FIG. 2, when the at least two strap portions of strap assembly 4 are then mounted on drill 10 in an operative position they conform to a shape of drill 10 as will hereinafter be described. Alternatively, strap assembly 4 may be formed without implementing step 22 so that the at least two strap portions will not conform to a shape of drill 10 when mounted thereon in an operative position.

Whether implementing step 22 or not, a further step may be included of coupling a slip resistant backing to at least a portion of an inner side of strap 5 similar to strap 3 as previously described. Additionally, another step may also be included of coupling the at least two strap portions along a plurality of lateral lines thereby forming, for example, sleeves 9 of FIG. 2 configured to slidably, removably receive and hold drill tools and accessories. Any coupling mechanisms may be utilized to partition the at least two strap portions into a plurality of sleeves 9, such adhesives, stitches, fasteners (e.g. snaps, rings, hooks-and-loops), clips, clamps, and/or the like. The distance between the coupling mechanisms, and thus the width of sleeves 9, may be varied to allow storage of various sizes and shapes of tools and accessories. Moreover, the coupling mechanisms themselves may be configured to longitudinally adjust and removably couple along the at least two strap portions. Notwithstanding, for the exemplary purposes of this disclosure, lateral stitches couple the at least two strap portions along a plurality of lateral lines thereby forming sleeves 9. Furthermore, still another step may also be included of either perforating at least a portion of at least one of the at least two strap portions or providing at least one prefabricated, perforated strap portion similar to strap 3 as previously described.

Turning to FIGS. 7–9 and for the exemplary purposes of this disclosure, top plan views are depicted during the fabrication of strap assembly 6 according to fabrication method 20 of FIG. 3. First step depicted in FIG. 7 is to provide outer strap 7 overlapping inner strap 8 with the straps being off set in the sense that a first end portion of outer strap 7 extends longitudinally beyond a first end portion of inner strap 8 while a second end portion of inner strap 8 extends longitudinally beyond a second end portion of outer strap 7. However, the straps may not be off set. Next step 22 depicted in FIG. 8 is to simultaneously twist outer strap 7 and inner strap 8 360° about a longitudinal axis extending from their first end portions to their second end portions. Last step 24 depicted in FIG. 9 is to couple the first end portions at least to the second end portions, thereby forming strap assembly 6 with outer strap 7 and inner strap 8. When outer strap 7 and inner strap 8 are then mounted on a drill in an operative position they will conform to its shape as will hereinafter be described. Alternatively, strap assembly 6 may be formed without implementing step 22 so that outer strap 7 and inner strap 8 will not conform to a shape of a drill when mounted thereon in an operative position.

Whether implementing step 22 or not, a further step may be included of coupling slip resistant backing 52 to at least a portion of an inner side of inner strap 8 similar to strap 3 as previously described. Additionally, another step may also be included of coupling outer strap 7 and inner strap 8 along a plurality of lateral lines thereby forming sleeves similar to sleeves 9 of strap 4 as previously described. Furthermore, still another step may also be included of either perforating at least a portion of outer strap 7 and/or inner strap 8 or providing a prefabricated, perforated outer strap 7 and/or inner strap 8 similar to strap 3 as 10 previously described.

Strap assemblies of the invention and their straps may have various lengths, widths, and thicknesses. For example, straps 3, 5, 7, and 8 may have approximately a 5"–50" length, approximately a ¼"–3" width, and approximately a 1/32"–⅛" thickness for the exemplary purposes of this disclosure depending upon the particular mounting application (e.g. the size and configuration of the drill), the tools and accessories to be held, and/or the particular material comprising the strap.

Components of strap assemblies of the invention may be formed of any of many different types of materials or combinations thereof, such as elastic materials, leather, vinyl, nylon, plastic, hook-and-loop materials, metal, wood, or other materials known in the art. An elastic material, such as rubber, woven, knitted and braided elastic fabrics, or any other resilient material, returns to its original shape once an applied force is removed. Rubber is suitable because of its inherent resiliency, tensioning, and slip-resistance properties (i.e., frictional and adhesive-like properties). Notwithstanding, for the exemplary purposes of this disclosure, the straps of the various strap assembly embodiments may be formed of a flat, woven, knitted, or braided elastic fabric that stretches to accommodate a variety of different shapes and sizes of drill tools.

Any strap of the invention may be purchased pre-manufactured or manufactured separately. Moreover, any strap may be purchased pre-manufactured or manufactured with its end portions simultaneously and integrally coupled together, thereby forming a continuous strap. Manufacture of any strap separately or simultaneously may involve injection molding, milling, cutting, sewing, and/or the like. If any strap is manufactured separately, it may then be coupled or removably coupled together at its end portions by any mechanism and in any manner known in the art, such as with adhesive, stitches, fasteners, clips, clamps, and/or the like for example, depending on, among other considerations, the particular material forming the components. For example, a strap may include a buckle assembly, snaps, rings, hooks-and-loops, or other fasteners to removably couple its end portions to one another. If a rings are included in a strap assembly mounted on a drill, they may be utilized to hang a drill from a nail, hook, screw, or other hanging device for storage in a shop or on the job site for example. Notwithstanding, for the exemplary purposes of this disclosure, straps described herein (e.g. strap 3, strap 5, and straps 7 and 8) may be coupled together by stitches (e.g. sewn together).

Figure 10:
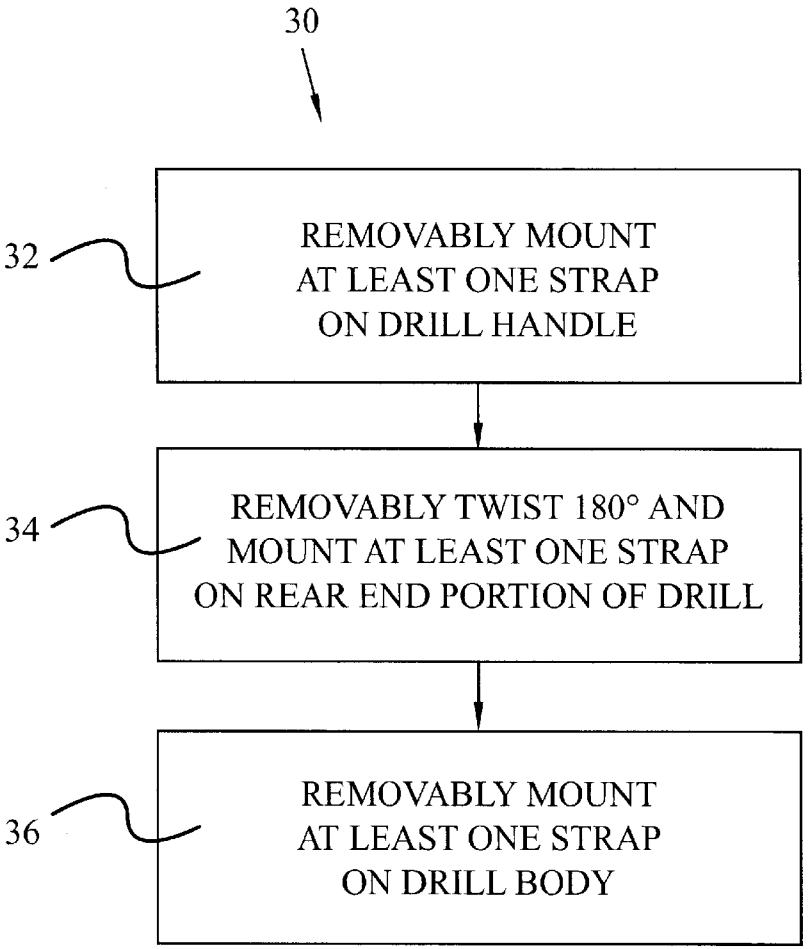
FIG. 10 is a flow diagram illustrating a method for installing a strap assembly embodiment of the invention in an operative position on a hand-held power drill.

Describing the mounting of strap assembly embodiments of the invention, it is within the scope of the invention for any strap assembly embodiment of the invention to removably mount on a drill in any fashion. Referring to FIG. 10 and for the exemplary purposes of this disclosure, exemplary method 30 for mounting a strap assembly in an operative position on a hand-held power drill in accordance with the invention is illustrated. Generally, mounting method 30 of invention may mount a strap assembly embodiment comprising at least one strap having a first end portion coupled to a second end portion by: removably mounting the at least one strap on the handle portion of the drill; removably twisting 180° and mounting the at least one strap on the rear end portion of the drill; and removably mounting the at least one strap on the rear body portion of the drill. It will be understood by one of ordinary skill in the art that the invention is not limited to mounting a specific strap assembly embodiment in a specific manner, as any strap assembly embodiment described herein may be mounted in any manner. Additionally, mounting methods of the invention apply to virtually any hand-held power drill.

Figure 11:
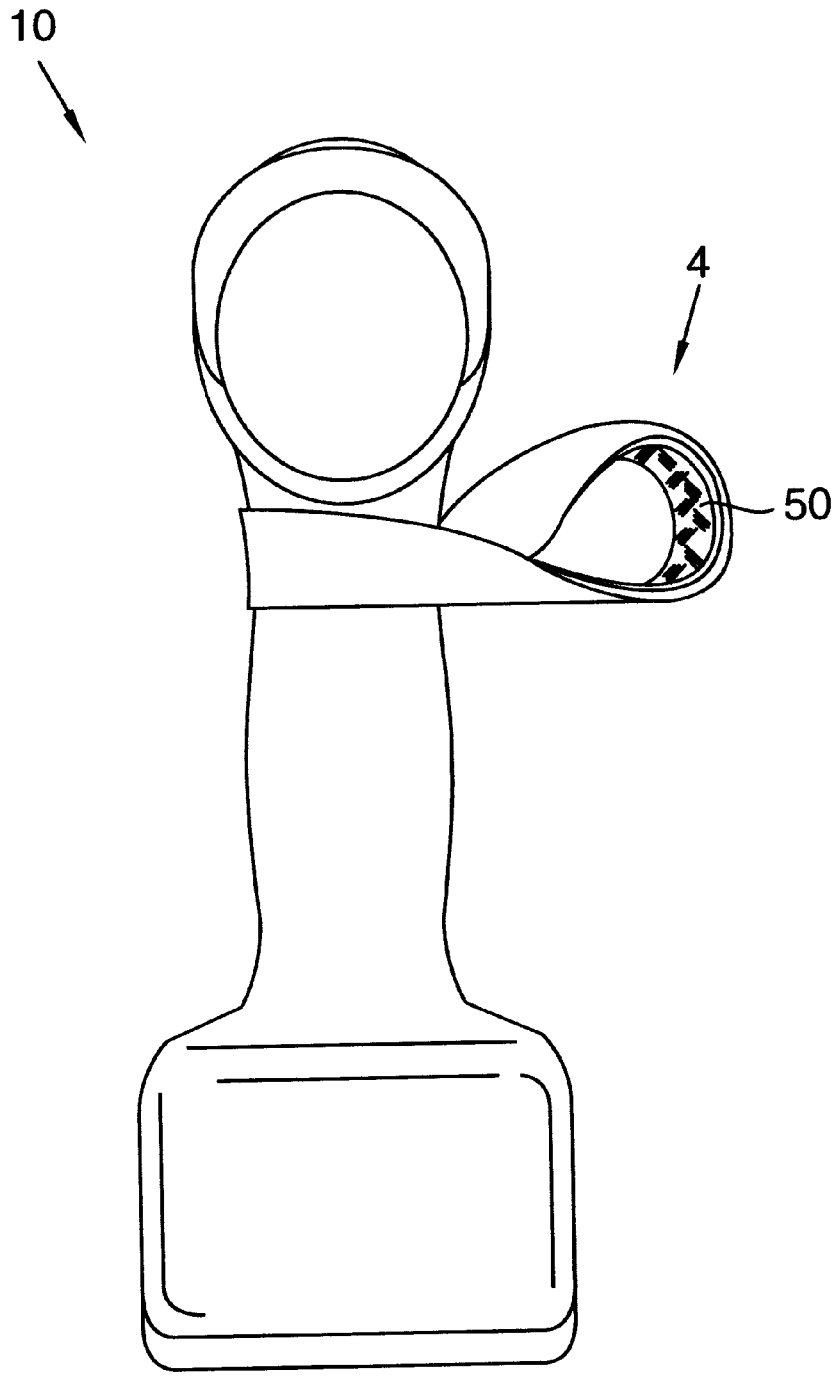
FIGS. 11–13 are rear end plan views of the strap assembly embodiment of FIG. 1 mounted in various operative positions on the cordless hand-held power drill during the installation method of FIG. 10.
Figure 12:
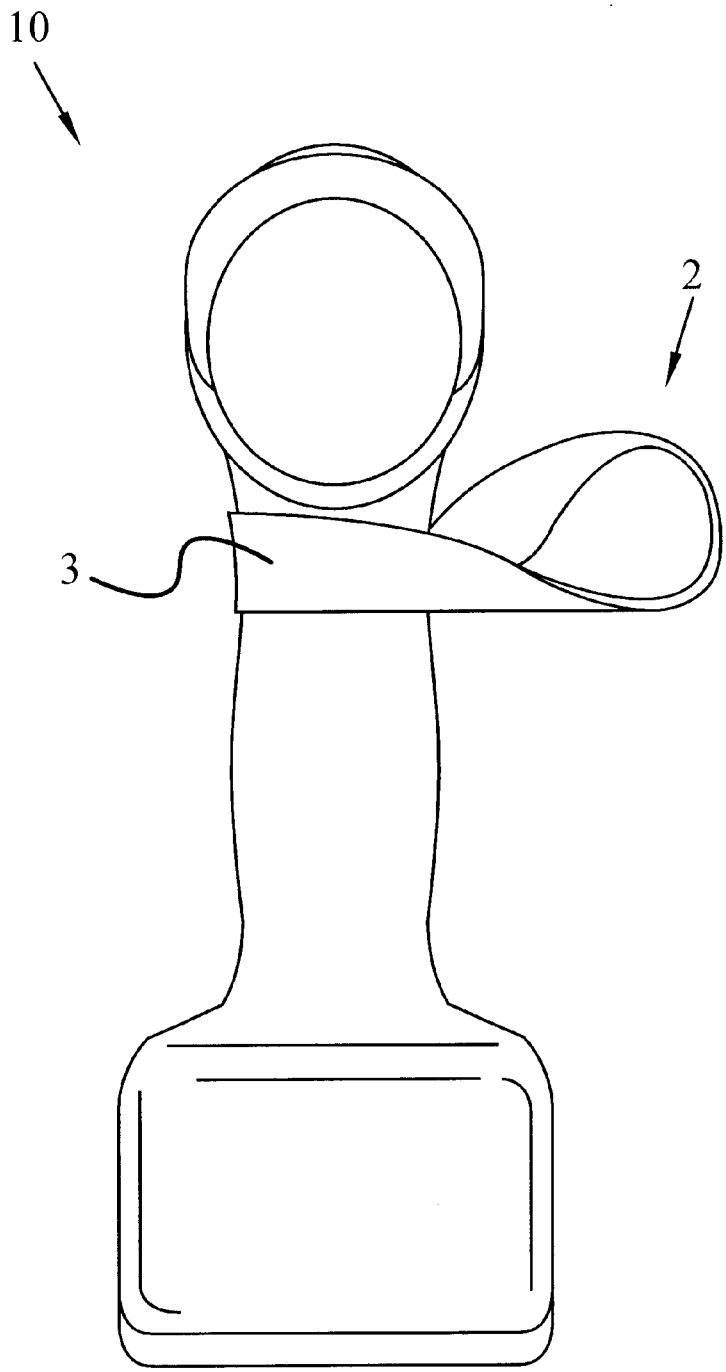
Figure 13:
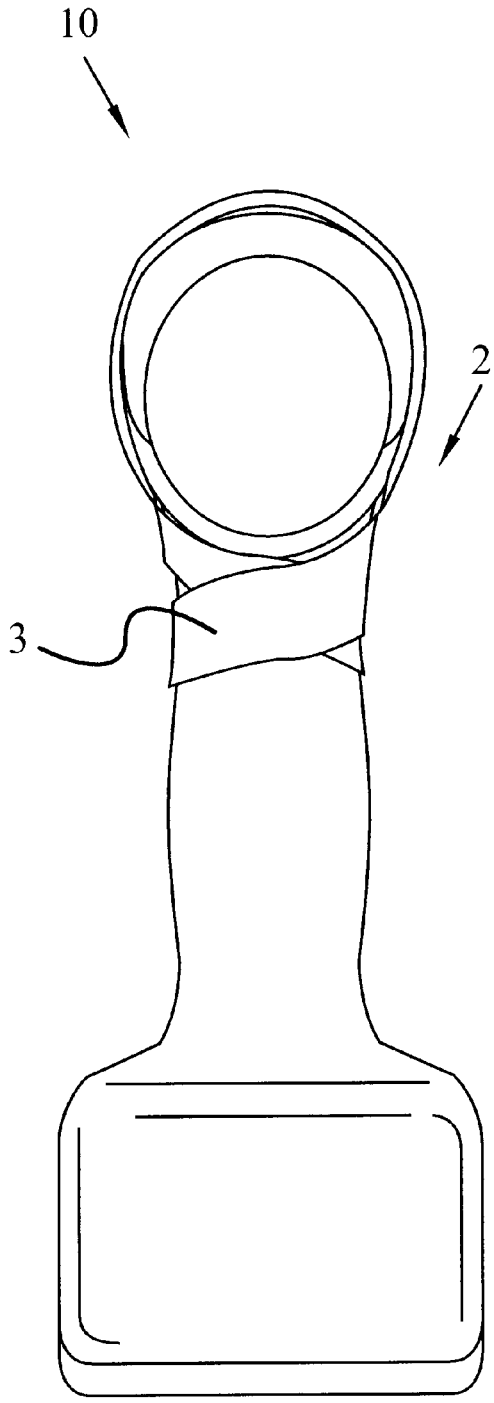

With reference to FIGS. 11–13 and for the exemplary purposes of this disclosure, rear plan views of strap assembly 2 mounted in operative positions on cordless hand-held power drill 10 are depicted during mounting method 30 of FIG. 10. Accordingly, first step 32 as depicted in FIG. 11 is to removably mount strap 3 on handle portion 12 of drill 10. Next step 34 as depicted in FIGS. 12–13 is to removably twist 180° and mount strap 3 on rear end portion 16 of drill 10 (e.g. approximately the junction of handle portion 12 and rear portion of body portion 14). Step 36 as depicted in FIG. 13 is to removably mount strap 3 on a rear portion of body portion 14 of drill 10. If strap assembly 4 of FIGS. 2 and 4–6 is utilized, wherein strap 5 overlaps itself to form at least two strap portions, steps 32–36 of mounting method 30 may comprise removably mounting, removably twisting 180° and mounting, and removably mounting the two strap portions on handle portion 12, rear end portion 16, and the rear portion of body portion 14 of drill 10 respectively in a similar manner as with strap 3. Likewise, if strap assembly 6 of FIGS. 7–9 is utilized, wherein outer strap 7 and inner strap 8 each have a first end portion at least coupled to a second end portion, steps 32–36 of mounting method 30 may comprise removably mounting, removably twisting 180° and mounting and removably mounting outer strap 7 and inner strap 8 on handle portion 12, rear end portion 16, and the rear portion of body portion 14 of drill 10 respectively in a similar manner as with strap 3.

The various fabrication methods of the invention as described herein enable method 30 to mount strap assemblies in an operative position on the drill so that they conform to a shape of a drill (i.e., the strap assemblies lie flat against themselves and the drill). Thus, for example, if strap assembly 2 is fabricated as previously described so that strap 3 is twisted 360° about a longitudinal axis extending from its first end portion to its second end portion prior to coupling the first end portion to the second end portion, steps 32–36 of mounting method 30 may further comprise a step of mounting strap 3 such that it conforms to a shape of drill 10, as depicted in FIGS. 1 and 11–13. Likewise, if strap assembly 4 is fabricated as previously described so that strap 5 is twisted 360° about a longitudinal axis extending from its first end portion to its second end portion prior to overlapping itself to form at least two strap portions and to coupling the first end portion to the second end portion, steps 32–36 may further comprise a step of mounting the at least two strap portions such that they conform to a shape of drill 10, as depicted in FIG. 2. Similarly, if strap assembly 6 is fabricated as previously described so that outer strap 7 and inner strap 8 are twisted 360° about a longitudinal axis extending from their first end portions to their second end portions prior to coupling the first end portions at least to the second end portions, steps 32–36 may further comprise a step of mounting outer strap 7 and inner strap 8 such that they conform to a shape of drill 10.

Strap assembly embodiments may be further configured to removably mount on a trigger of a drill to maintain the trigger in a depressed position, thereby providing for continuous drill operation. Accordingly, referring to FIG. 1, mounting method 30 may further comprise a step of removably mounting strap 3 from the approximate position represented by dashed lines on/over trigger 18 of drill 10 to maintain trigger 18 in a depressed position. Likewise, if strap assembly 4 as depicted in FIGS. 2 and 6 is utilized for example, at least one of the outer strap portion and the inner strap portion may be configured to removably mount on trigger 18 of drill 10 in a like manner to maintain trigger 18 in a depressed position. Similarly, if strap assembly 6 as depicted in FIG. 9 is utilized for example, at least one of outer strap 7 and inner strap 8 may be configured to removably mount on trigger 18 of drill 10 in a like manner to maintain trigger 18 in a depressed position.

Strap assembly embodiments may also be configured to further cushion a handle portion of a drill. That is, strap assemblies may add to the comfort of the handle portion of the drill if the strap material is soft so as to cushion an operators hand from the hard plastic and the vibrations of the drill. Accordingly, referring to FIG. 2 for example, mounting method 30 may further comprise a step of removably separating the at least two strap portions of strap assembly 4 along handle portion 12 of drill 10 to cushion handle portion 12. [The position of one of the at least two strap portions when separated is represented approximately by dashed lines.] Likewise, if strap assembly embodiment 6 as depicted in FIG. 9 is utilized for example, outer strap 7 and inner strap 8 may be removably separated along handle portion 12 of drill 10 in a like manner to cushion handle portion 12 as well.

Thus, unlike conventional drill tool holding devices mounted on drills that slip off a drill over time and heavy use (during the removal and insertion of tools and accessories), strap assembly embodiments of the invention are configured and mounted in such a manner so that they resist sliding off a drill. This sliding resistance may be provided by, among other factors: the manner in which strap assembly may be mounted on both the handle portion and the rear body portion of a drill so that the strap assembly crosses itself at a rear end portion of the drill for example, and/or a slip resistant backing coupled to at least a portion of an inner side of at least one strap mounted on a rear body portion of a drill for example.

Notwithstanding the foregoing, other mounting methods are within the scope of the invention depending upon the mounting application and drill configuration for example. Any strap assembly embodiment described herein may be utilized by these other mounting methods. Accordingly and using drill 10 of FIG. 1 to illustrate, in mounting strap assembly 2 comprising strap 3 not yet having a first end portion coupled to a second end portion, a first alternative mounting method may generally include the steps of: removably wrapping strap 3 around handle portion 12, rear end portion 16, and a rear portion of body portion 14 of drill 10; and then coupling or removably coupling strap 3's first end portion to its second end portion. Strap assembly 4 not yet having a first end portion coupled to a second end portion and strap assembly 6 not yet having first end portions coupled to second end portions may also be mounted in similar manners.

A second alternative mounting method for strap assembly 2 comprising strap 3 having a first end portion coupled to a second end portion may generally include the steps of: removably mounting strap 3 on a handle portion of a drill; removably twisting 180° and mounting strap 3 on a front end portion of the drill (e.g. approximately the junction of handle portion 12 and a front portion of body portion 14 of the drill); and removably mounting strap 3 on a front portion of a body portion of the drill. Strap assemblies 4 and 6 may also be mounted in similar manners.

A third alternative mounting method for strap assembly 2 comprising strap 3 not yet having a first end portion coupled to a second end portion may generally include the steps of: removably wrapping strap 3 around a handle portion, a front end portion, and a front portion of a body portion of a drill; and then coupling or removably coupling strap 3's first end portion to its second end portion. Strap assembly 4 not yet having a first end portion coupled to a second end portion and strap assembly 6 not yet having first end portions coupled to second end portions may also be mounted in similar manners.

Again using drill 10 of FIG. 1 to illustrate, a fourth alternative mounting method for strap assembly 2 comprising strap 3 having a first end portion coupled to a second end portion may generally include the steps of: removably mounting strap 3 on rear end portion 16 of drill 10; removably twisting 180° and mounting strap 3 on a central portion of body portion 14 of drill 10; and removably mounting strap 3 on a front end portion of drill 10. Strap assemblies 4 and 6 may also be mounted in similar manners.

Still using drill 10 of FIG. 1 to illustrate, a fifth alternative mounting method for strap assembly 2 comprising strap 3 not yet having a first end portion coupled to a second end portion may generally include the steps of: removably wrapping strap 3 around rear end portion 16, a central portion of body portion 14, and a front end portion of drill 10; and then coupling or removably coupling strap 3's first end portion to its second end portion. Strap assembly 4 not yet having a first end portion coupled to a second end portion and strap assembly 6 not yet having first end portions coupled to second end portions may also be mounted in similar manners.

Describing the use of strap assembly embodiments of the invention further and for the exemplary purposes of this disclosure, strap assembly embodiments may securely store and maintain accessible virtually any shape and size of drill tool and accessory on the drill between the strap assembly and/or within sleeves depending upon the particular strap assembly. Such drill tools and accessories may include drill bits, drill gimlets, tool bits, sockets, grinders, chuck keys, pen lights, oil tubes, writing utensils, brushes, and other related tools and accessories. If a strap assembly is formed of an elastic material, the strap assembly holds and stores the drill tools and accessories in place by the tension of the strap assembly on the drill, as well as stretches to accommodate virtually any shape or size of tool or accessory.

Accordingly, strap assembly embodiments allow immediate use of drill tools and accessories by drill operators. For example, as depicted in FIG. 1, strap assembly 2 is configured to slidably, removably receive and hold accessories including pen lights, pencils, and oil tubes, as well as drill tools, in between strap assembly 2 and drill body 14. As exemplified in FIG. 2, strap assembly 4 is also configured to slidably, removably receive and hold drill tools including screw driver bits, drill bits, and grinders, as well as accessories, in sleeves 9.

Additionally, strap assembly embodiments are configured to mount on virtually any size, shape, make, and model of hand-held drills. Furthermore, strap assembly embodiments act as a cushion to the drill body since a strap assembly is the point of contact with surfaces when the drill is dropped or laid on its side.

Thus, the invention provides a strap assembly that may include at least one strap configured to removably mount on a handle portion of a drill, to removably twist 180° and mount on a rear end portion of the drill, and to removably mount on a rear body portion of the drill. Methods for fabricating and mounting a strap assembly are also disclosed. The fabrication method may generally include steps of: twisting the at least one strap 360° about a longitudinal axis extending from a first end portion of the strap to the second end portion of the strap; and coupling the first and second end portions together. The mounting method may generally include steps of: removably mounting the at least one strap on the handle portion of the drill; removably twisting 180° and mounting the at least one strap on the rear end portion of the drill; and removably mounting the at least one strap on the rear body portion of the drill.

Therefore, strap assemblies of the invention overcome the aforementioned drawbacks of previous conventional drill tool holding devices by providing certain advantages including: holding many shapes and sizes of tools and accessories away from the handle portion of the drill; resisting sliding off the drill over time and heavy use; protecting the body of the drill if dropped or laid on it's side; adding to the comfort of the drill handle by cushioning the hand from the hard plastic and the vibrations of the drill; acting as a trigger hold to maintain the trigger in a depressed position; and fitting virtually any make and model of hand-held power drills, externally powered or cordless. Moreover, strap assemblies of the invention are easy to manufacture, assemble, and install.

The embodiments and examples set forth herein were presented in order to best explain the invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, unless otherwise specified, any components of the invention indicated in the drawings or herein are given as an example of possible components and not as a limitation. Similarly, unless otherwise specified, any steps or sequence of steps of the method of the invention indicated herein are given as examples of possible steps or sequence of steps and not as limitations.

What is claimed is:

1. A hand-held power drill and strap assembly comprising:

a hand-held power drill; and at least one strap having a first end portion coupled to a second end portion, wherein the at least one strap is removably mounted on a handle portion of the drill, wherein the at least one strap is removably twisted 180° so that the at least one strap crosses itself on a rear end portion of the drill, and wherein the at least one strap is removably mounted on a rear body portion of the drill.

2. The hand-held power drill and strap assembly of claim 1, wherein the at least one strap is continuous.

3. The hand-held power drill and strap assembly of claim 1, wherein the at least one strap is elastic.

4. The hand-held power drill and strap assembly of claim 1, wherein a slip resistant backing is coupled to at least a portion of an inner side of the at least one strap on the rear body portion of the drill.

5. The hand-held power drill and strap assembly of claim 1, wherein the at least one strap is further removably mounted on a trigger of the drill to maintain the trigger in a depressed position.

6. The hand-held power drill and strap assembly of claim 1, wherein the at least one strap is twisted 360° about a longitudinal axis extending from the first end portion to the second end portion prior to coupling the first end portion to the second end portion such that the at least one strap lies flat against itself and the drill.

7. The hand-held power drill and strap assembly of claim 1, wherein the at least one strap overlaps itself to form at least two strap portions.

8. The hand-held power drill and strap assembly of claim 7, wherein the at least two strap portions are coupled along a plurality of lateral lines thereby forming sleeves.

9. The hand-held power drill and strap assembly of claim 7, wherein the at least two strap portions are removably separated along the handle portion of the drill to cushion the handle portion.

10. The hand-held power drill and strap assembly of claim 7, wherein the at least one strap is twisted 360° about a longitudinal axis extending from the first end portion to the second end portion prior to overlapping itself to form the at least two strap portions and to coupling the first end portion to the second end portion such that the at least two strap portions lie flat against themselves and the drill.

11. The hand-held power drill and strap assembly of claim 1, wherein the at least one strap comprises an outer strap overlapping an inner strap, wherein the outer strap and the inner strap each have a first end portion at least coupled to a second end portion, wherein the outer strap and the inner strap each are removably mounted on the handle portion of the drill, wherein the outer strap and the inner strap each are twisted 180° so that the outer strap and the inner strap each cross themselves on the rear end portion of the drill, and wherein the outer strap and the inner strap each are removably mounted on the rear body portion of the drill.

12. The hand-held power drill and strap assembly of claim 11, wherein the outer strap and the inner strap each are continuous.

13. The hand-held power drill and strap assembly of claim 11, wherein a slip resistant backing is coupled to at least a portion of an inner side of the inner strap around the rear body portion of the drill.

14. The hand-held power drill and strap assembly of claim 11, wherein at least one of the outer strap and the inner strap is removably mounted on a trigger of the drill to maintain the trigger in a depressed position.

15. The hand-held power drill and strap assembly of claim 11, wherein the outer strap and the inner strap are coupled along a plurality of lateral lines thereby forming sleeves.

16. The hand-held power drill and strap assembly of claim 11, wherein the outer strap and the inner strap are removably separated along the handle portion of the drill to cushion the handle portion.

17. The hand-held power drill and strap assembly of claim 11, wherein the outer strap and the inner strap are simultaneously twisted 360° about a longitudinal axis extending from the first end portions to the second end portions prior to coupling the first end portions at least to the second end portions such that the outer strap and the inner strap lie flat against themselves and the drill.

* * * * *